US008397313B2

(12) United States Patent
Bevier

(10) Patent No.: US 8,397,313 B2
(45) Date of Patent: Mar. 19, 2013

(54) DURABLE ATHLETIC GLOVE WITH ENHANCED RANGE OF MOTION

(75) Inventor: Joseph J. Bevier, Portland, OR (US)

(73) Assignee: Nike, Inc., Beaverton, OR (US)

( * ) Notice: Subject to any disclaimer, the term of this patent is extended or adjusted under 35 U.S.C. 154(b) by 181 days.

(21) Appl. No.: 12/851,341

(22) Filed: Aug. 5, 2010

(65) Prior Publication Data

US 2012/0030856 A1 Feb. 9, 2012

(51) Int. Cl.
*A63B 71/14* (2006.01)
*A41D 19/00* (2006.01)

(52) U.S. Cl. ..... 2/159; 2/160; 2/161.1; 2/162; 2/169; 2/275

(58) Field of Classification Search ..... 2/159, 160, 2/161.1–161.8, 162–169, 275, 907
See application file for complete search history.

(56) References Cited

U.S. PATENT DOCUMENTS 1,584,304 A * 5/1926 Kennedy ..... 2/16
2,227,586 A * 1/1941 Johnson ..... 2/169
2,883,668 A * 4/1959 Owczarek ..... 2/159
2,970,317 A * 2/1961 Winson ..... 2/169
3,602,917 A * 9/1971 Seunevel et al. ..... 2/167
4,868,927 A * 9/1989 Bourdeau et al. ..... 2/161.1
5,603,118 A * 2/1997 Solomon ..... 2/20
5,708,980 A * 1/1998 LaManna et al. ..... 2/163
5,758,364 A * 6/1998 Rewoldt ..... 2/160
5,787,506 A * 8/1998 Wilder et al. ..... 2/161.1
5,790,980 A * 8/1998 Yewer, Jr. ..... 2/20
5,911,313 A * 6/1999 Gold ..... 2/159
6,041,438 A * 3/2000 Kirkwood ..... 2/161.1
6,115,842 A * 9/2000 Hochmuth ..... 2/161.1
6,125,473 A * 10/2000 Hochmuth ..... 2/161.1
6,654,965 B2 * 12/2003 Hochmuth ..... 2/161.1
6,745,402 B2 * 6/2004 Caswell ..... 2/161.1
2003/0167553 A1 * 9/2003 Caswell et al. ..... 2/161.1
2004/0221365 A1 * 11/2004 Fitzgerald ..... 2/159
2005/0120453 A1 * 6/2005 Wu ..... 2/19
2009/0313742 A1 * 12/2009 Smeltzer ..... 2/161.2
2011/0296582 A1 * 12/2011 Bevier et al. ..... 2/161.1
2012/0030855 A1 * 2/2012 Clark ..... 2/161.1

OTHER PUBLICATIONS

Collins english dictionary; HarperCollins Publishers 1991, 1994, 1998, 2000, 2003.*

* cited by examiner

*Primary Examiner* — Bobby Muromoto, Jr.
(74) *Attorney, Agent, or Firm* — Shook, Hardy & Bacon L.L.P.

(57) ABSTRACT

A durable athletic glove with an enhanced range of motion is provided. The glove has a palm-side portion and a back portion connected to form four finger sheaths, a thumb sheath, and an opening capable of receiving a human hand. One or more rounded, strain-relieving cutouts are located on the palm portion at a location corresponding to the area of a user's hand where two adjacent fingers connect with the palm. A strain-relieving finger gusset connects each cutout to the finger sheaths and palm-side portion. A thumb gusset extends from the back portion, between the thumb sheath and index finger sheath, and to the palm-side portion. The strain-relieving cutouts and strain-relieving gussets distribute force applied where finger sheaths connect to minimize glove failure. The cutouts and gussets allow an increased range of motion and stretchability for the user.

9 Claims, 4 Drawing Sheets

DURABLE ATHLETIC GLOVE WITH ENHANCED RANGE OF MOTION

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to athletic gloves. More particularly, the present invention relates to a durable athletic glove that provides improved range of motion.

BACKGROUND

Both professional and amateur athletes often wear athletic gloves when playing sports. In football, for example, wide receivers, tight ends, running backs, and others whose performance depends upon the ability to effectively grip the football often wear gloves to enhance their grip on the football. Other position players, such as offensive and defensive lineman, may wear gloves to protect their hands during play.

Athletic gloves are often subjected to a substantial amount of stress when worn in football and other sports. Athletes repeatedly open, close, stretch, and constrict their hands while catching, throwing, grabbing, pushing, and pulling as required on the field. Athletic gloves often fail as a result of this stress. One frequent area of failure is between adjacent fingers where the fingers join the hand. Additionally, conventional athletic gloves often restrict an athlete's range of hand motion beyond desirable levels.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present invention relates to a durable athletic glove with an enhanced range of motion. The glove may comprise a back portion and a palm-side portion having four finger portions, a thumb portion, and a central palm portion. The palm-side portion may be connected to the back portion to form four finger sheaths, a thumb sheath, and an opening capable of receiving a human hand. The opening may be located opposite the four finger sheaths and corresponds approximately to the wrist of a user when the glove is worn by the user with fingers of the user extending within the four finger sheaths and the thumb of the user extending within the thumb sheath.

The glove may also comprise one or more rounded, strain-relieving cutouts, the location of the cutouts corresponding to one of the areas on the palm of the user's hand between the distal ends of adjacent finger metacarpals. A strain-relieving finger gusset may connect each cutout to the finger portions and central palm portion. A thumb gusset extends from the back portion, between the thumb sheath and index finger sheath, and to the palm-side portion.

BRIEF DESCRIPTION OF THE DRAWINGS

The present invention is described in detail below with reference to the attached drawing figures, wherein.

DETAILED DESCRIPTION

In conventional athletic gloves, stress on the gloves often leads to glove failure, especially in the areas where two adjacent finger sheaths meet. Additionally, conventional athletic gloves often restrict an athlete's ability to fully stretch and move his or her hand. Gloves in accordance with the present invention provide durable athletic gloves that allow an extended range of motion. Durability may be increased by including one or more strain-relieving cutouts in the area where finger sheaths join to better distribute the force applied when a user stretches her fingers apart. The strain-relieving cutouts may also allow the user to stretch her fingers farther apart than conventional "V" connection of finger sheaths. Gloves in accordance with the present invention may also provide a thumb gusset that extends from the back of the glove, between the thumb sheath and index finger sheath, and to the palm of the glove. The thumb gusset allows a fuller range of motion for the thumb and increases the distance the thumb can be stretched away from the index finger.

Figure 1:
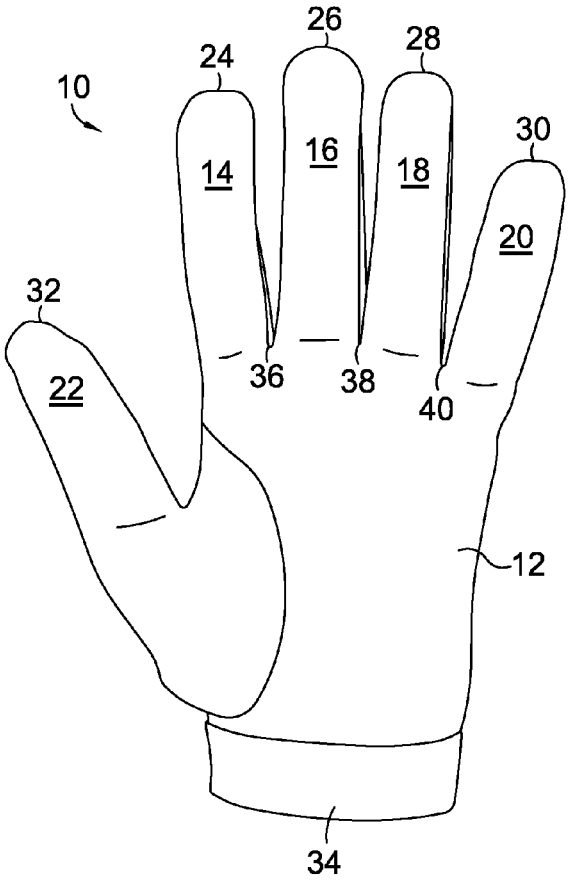
FIG. 1. PRIOR ART
FIG. 1 is a perspective view of a prior art conventional athletic glove.

FIG. 1 illustrates a prior art conventional athletic glove 10. Glove 10 comprises a back portion (not shown) and a palm-side portion 12. Palm-side portion 12 includes four finger portions 14, 16, 18, and 20, and thumb portion 22. Finger portions 14, 16, 18, and 20, thumb portion 22, and the back portion are connected to form four finger sheaths 24, 26, 28, and 30, a thumb sheath 32, and an opening 34 capable of receiving a human hand. Adjacent finger portions are connected in a conventional "V" fashion. Finger portions 14 and 16 are connected at connection point 36, finger portions 16 and 18 are connected at connection point 38, and finger portions 18 and 20 are connected at connection point 40. As discussed above, connection points 36, 38, and 40 experience significant stress when glove 10 is worn while an athlete is playing sports. Connection points 36, 38, and 40 often fail as a result of this stress.

Figure 2:
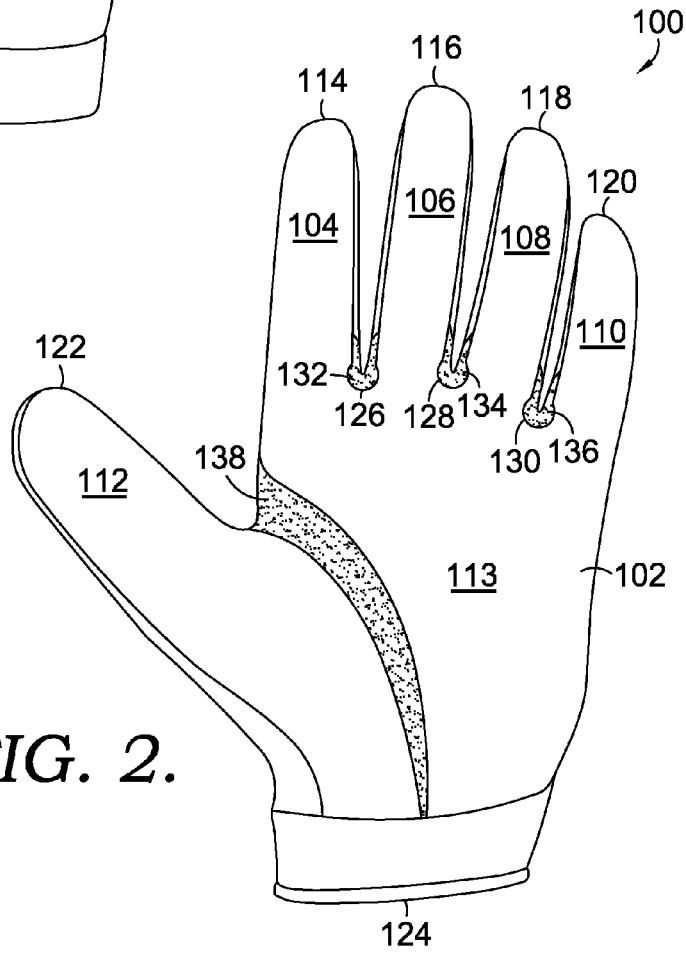
FIG. 2 is a perspective view of a durable athletic glove with enhanced range of motion showing the palm side of the glove in a neutral position.

Examples of gloves in accordance with the present invention, illustrated in FIGS. 2-9, provide durable athletic gloves with increased range of motion that include strain-relieving cutouts that limit glove failure in these areas. FIG. 2 illustrates a palm view of athletic glove 100. Glove 100 comprises a back portion (not shown) and a palm-side portion 102. Palm-side portion 102 includes four finger portions 104, 106, 108, and 110, a thumb portion 112, and a central palm portion 113. Finger portions 104, 106, 108, and 110, thumb portion 112, central palm portion 113 and the back portion are connected to form four finger sheaths 114, 116, 118, and 120, a thumb sheath 122, and an opening 124 capable of receiving a human hand.

Rounded strain-relieving cutouts 126, 128, and 130 connect finger portions 104, 106, 108, and 110. The location of each cutout corresponds to one of the areas on the palm of the user's hand between distal ends of adjacent finger metacarpals. Each cutout connects the two adjacent finger portions that are part of the corresponding two adjacent finger sheaths. Strain-relieving cutout 126 connects finger portions 104 and 106 of adjacent finger sheaths 114 and 116, strain-relieving cutout 128 connects finger portions 106 and 108 of adjacent finger sheaths 116 and 118, and strain-relieving cutout 130 connects finger portions 108 and 110 of adjacent finger sheaths 118 and 120.

The rounded shape of cutouts 126, 128, and 130 acts to spread any stress applied to the cutouts along the entire length of the cutout. With conventional connection points, such as points 36, 38, and 40 of glove 10 illustrated in FIG. 1, stress applied by separating adjacent finger portions (or otherwise applied) focuses primarily on the connection point, often causing the glove to rip or tear at this point. Rounded strain-relieving cutouts 126, 128, and 130, however, redistribute applied stress along the cutout, limiting glove failure. Although three strain-relieving cutouts are shown in FIG. 2, in some examples, only one or two cutouts are present. For example, a connection point may be identified as the one that experiences the most stress as the result of a particular activity, and a rounded strain-relieving cutout is included only for this finger connection. In some examples, the strain-relieving cutouts may be a shape other than rounded. For example, the cutouts may have a number of approximately straight sides to approximate a rounded cutout. In another example, the strain-relieving cutouts may approximate the shape of polygons such as squares, pentagons, hexagons, octagons, etc.

Cutouts 126, 128, and 130 are positioned and limited in size so as not to reduce the protection, grip, or other functionality of glove 100. As discussed above, stress-relieving cutouts 126, 128, and 130 are located in the part of palm-side portion 102 corresponding to the area between distal ends of adjacent finger metacarpals of a user's hand. The metacarpal bones run approximately from the wrist to the base of each finger and thumb, connecting the carpals at the base of the hand to the proximal phalanges of the lower finger. The distal end of a metacarpal is the end connected to a proximal phalange (the end furthest from the wrist). The metacarpal bones are larger at the ends than at the center, causing the area of the palm over the distal ends of the metacarpals to sit higher than the area between the distal ends of adjacent metacarpals. Pressure applied to the upper palm, such as when a ball is caught or an item is gripped, is therefore most significantly applied to the portion of the palm directly over the distal ends of the metacarpals.

Locating cutouts 126, 128, and 130 in the area between the distal ends of the metacarpals and limiting the size of the cutouts allows the high pressure-and-stress-receiving areas to be covered by the glove gripping material. Strain relief is thus provided without negatively impacting performance. Each of cutouts 126, 128, and 130 may form part of a substantially circular outline when glove 100 is worn with the user's hand in a neutral position as illustrated in FIG. 2. This is illustrated more clearly in FIGS. 3-5.

With reference again to FIG. 2, each of rounded strain-relieving cutouts 126, 128, and 130 is connected to the corresponding two adjacent finger sheaths via a strain-relieving finger gusset. Strain-relieving finger gusset 132 connects cutout 126 with adjacent finger sheaths 114 and 116, strain-relieving finger gusset 134 connects cutout 128 with adjacent finger sheaths 116 and 118, and strain-relieving finger gusset 136 connects cutout 130 with adjacent finger sheaths 118 and 120. Strain-relieving finger gussets 132, 134, and 136 are made of a stretchable material such as spandex to allow a user maximum range of movement. Gussets 132, 134, and 136 may be formed from a woven or knitted spandex blend material that is breathable.

Each of finger sheaths 114, 116, 118, and 120 may also include one or more side finger gussets, not shown, that connect finger portions 104, 106, 108, and 110 to the back portion of glove 100. The side finger gussets may also be made of a stretchable material. In some examples, each of strain-relieving finger gussets 132, 134, and 136 and the two adjacent side finger gussets form one continuous piece of material. In other examples, gussets 132, 134, and 136, along with the side finger gussets adjacent to each of gussets 132, 134, and 136, together form one continuous piece of material.

Figure 6:
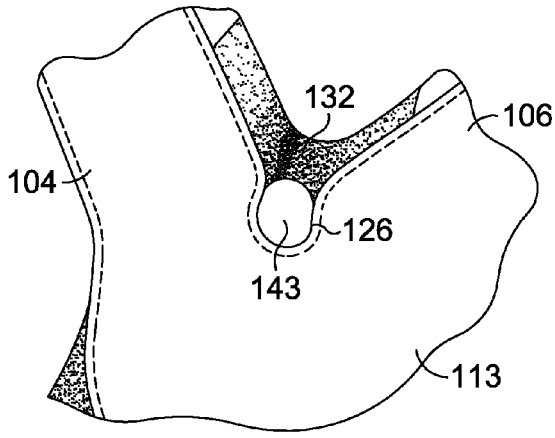
FIG. 6 is a partial perspective view of the rounded strain-relieving cutout shown in FIG. 2 with a vent located between a portion of the cutout and the corresponding gusset.

Strain-relieving gussets 132, 134, and 136 may include "negative space" such that there is a void between portions of each of cutouts 126, 128, and 130 and the material of corresponding strain-relieving gussets 132, 134, and 136. This negative space acts as a vent and can improve breathability. The negative space may also be entirely surrounded by the material of the corresponding strain-relieving gussets 132, 134, and 136 rather than between the gusset and corresponding cutout. An example of a vent located between a portion of cutout 126 and corresponding strain-relieving gusset 132 is shown in FIG. 6.

With reference again to FIG. 2, the side finger gussets may be "split" gussets in which the portion of the gussets closest to finger portions 104, 106, 108, and 110 are the same material as the finger portions, and the portion of the gussets closest to the back portion is the same material as the back portion. The back portion of glove 100 may be made of a number of materials, including gripping material such as leather or synthetic leather, as well as stretchable materials such as spandex. Palm-portion 102 can also be made of a number of materials but is preferably made of a gripping material such as leather, synthetic leather, or silicon.

Glove 100 of FIG. 2 also includes a thumb gusset 138. Thumb gusset 138 connects thumb portion 112 to central palm portion 113 and extends from the back portion, between thumb sheath 122 and index finger sheath 114, and to palm-side portion 102. As illustrated in FIG. 2, thumb gusset 138 extends substantially to both the opening adjacent to the back portion and to the opening adjacent to central palm portion 113. In other examples, thumb gusset 138 extends only part of the way down the back and/or palm-side portions toward the opening. The width and geometry of thumb gusset 138 varies according to the particular design. Thumb gusset 138 provides freedom of movement for a user's thumb while the glove is worn.

As with the strain-relieving finger gussets, thumb gusset 138 is preferably made of a stretchable material such as spandex. The human opposable thumb can be extremely useful and important in various gripping, catching, or other athletic activities, and thumb gusset 138 mitigates the constraining effect glove 100 might have on that movement. In conjunction with the strain-relieving cutouts and finger gussets, thumb gusset 138 allows a user wearing glove 100 to stretch her hand to very nearly the same extent as the user is able to when not wearing glove 100. A conventional athletic glove, however, such as glove 10 in FIG. 1, does not provide the range of motion or stretching extent provided by glove 100. The strain-relieving finger gussets, cutouts, and thumb gussets can be thought of as providing a "dynamic fit," where the gussets allow movement and stretching such that regardless of the state of the user's hand, the glove fit remains natural by allowing the gussets to stretch and not restricting movement with conventional finger sheath connection points. This dynamic fit allows for quick expansion and contraction of the hand, such as when opening the hand to catch a football, without constraining the natural motion of the hand.

Strain-relieving finger gussets 132, 134, and 136, and any side finger gussets may be attached to finger portions 104, 106, 108, and 110, central palm portion 113, and the back portion through a number of means such as stitching, heated bonding, or ultrasonic welding. The location and small size of cutouts 126, 128, and 130, as described above, places the stitching, bonding, or other connection means of the strain-relieving finger gussets to the cutouts away from the primary pressure-receiving portions of the palm in order to minimize irritation of the hand caused by the seams.

Figure 3:
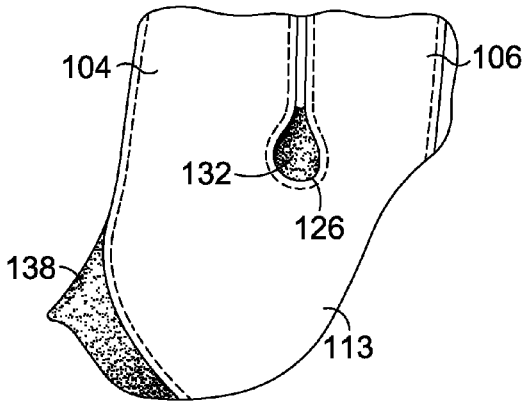
FIG. 3 is a zoomed partial perspective view of a rounded strain-relieving cutout in the glove shown in FIG. 2 with the fingers of the glove in a closed position.
Figure 4:
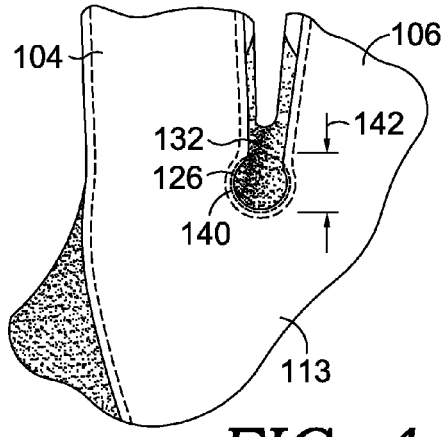
FIG. 4 is a partial perspective view of the rounded strain-relieving cutout shown in FIG. 3 with the fingers of the glove in a neutral position.
Figure 5:
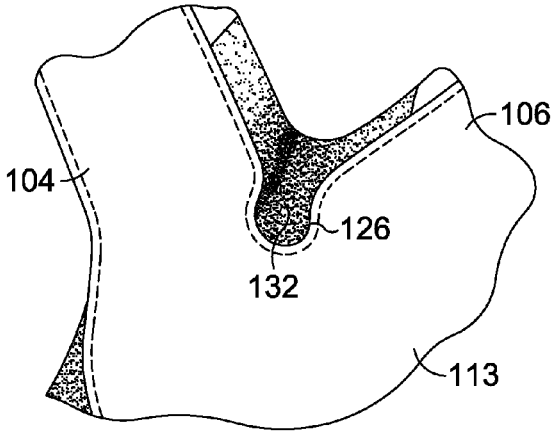
FIG. 5 is a partial perspective view of the rounded strain-relieving cutout shown in FIGS. 3 and 4 with the fingers of the glove in an open position.

FIGS. 3-5 further illustrate strain-relieving cutout 126 and strain-relieving finger gusset 132 in closed, neutral, and open positions. FIG. 3 shows cutout 126 and gusset 132 when the hand of a user wearing glove 100 is in a closed position with the fingers together and extended. Cutout 126 allows the fingers of a user to be brought together without causing finger portions 104 and 106 and central palm portion 113 to bunch, which might impact performance. FIG. 4 illustrates a neutral position with the fingers slightly apart and extended. Strain-relieving cutout 126 forms part of a substantially circular outline 140 having a diameter 142 of between four and twelve millimeters. In one example, diameter 142 of substantially circular outline 140 is approximately eight millimeters. Other shapes for cutout 126 are possible that are not substantially circular, such as oval and elliptical. In some examples, one or more of cutouts 126, 128, and 130 are shaped differently. FIG. 5 illustrates an open or stretched position.

FIG. 6 is an example of strain-relieving cutout 126 and corresponding strain-relieving finger gusset 132 of glove 100 connected such that a vent 143 is created between a portion of cutout 126 and gusset 132. Vent 143 is a void or hole and may be thought of as "negative space" as discussed above. Vent 143 provides increased breathability and ventilation to a user's hand without exposing areas of the hand that come into contact with other objects. Although vent 143 as shown in FIG. 6 is rounded and substantially circular, vent 143 may have a variety of geometries. In some examples, vent 143 is surrounded entirely by gusset 132 rather than located between cutout 126 and gusset 132. That is, gusset 132 may extend along the entirety of cutout 126, and vent 143 is located near cutout 126 but within gusset 132.

Figure 7:
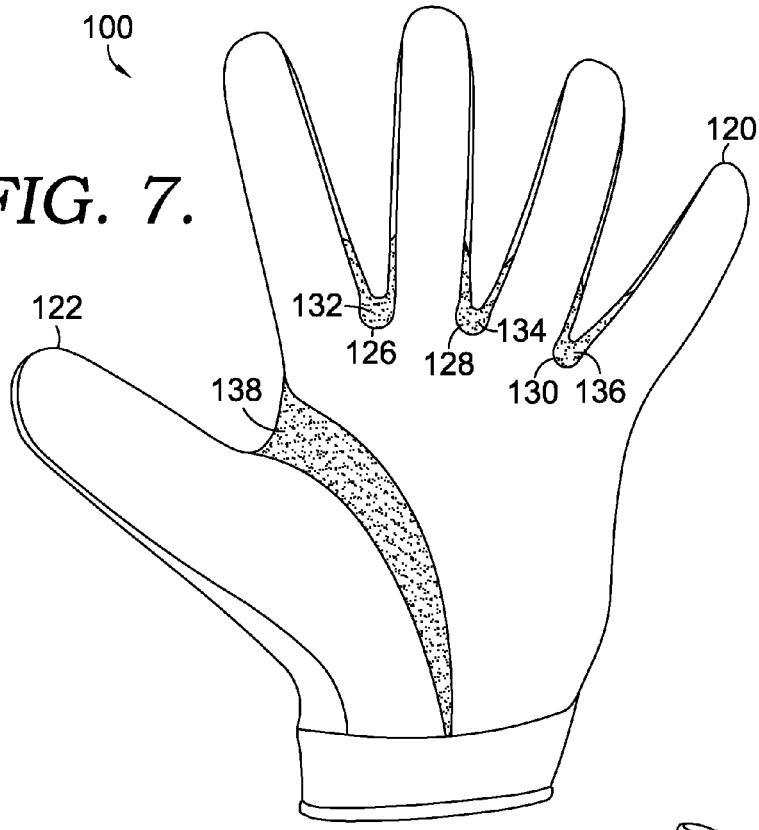
FIG. 7 is a perspective view of a durable athletic glove with enhanced range of motion showing the palm of the glove in an open position.

FIG. 7 illustrates the palm side of glove 100 in an open or stretched position. Strain-relieving cutouts 126, 128, and 130 and strain-relieving finger gussets 132, 134, and 136, along with thumb gusset 138, allow a user wearing glove 100 to stretch her hand and extend the distance between the tip of thumb sheath 122 and the tip of pinky finger sheath 120 to a distance closely approximating the distance the user would be able to stretch her hand while not wearing a glove. Conventional athletic gloves do not allow a user's hand to stretch to this extent.

Figure 8:
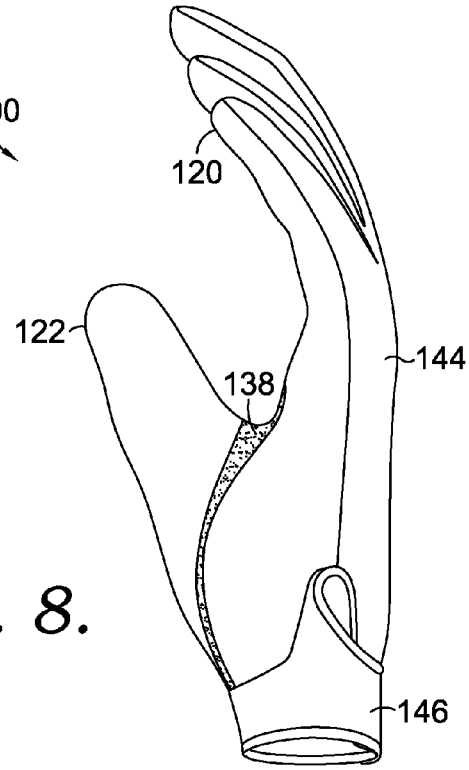
FIG. 8 is a perspective view of a durable athletic glove with enhanced range of motion showing the pinky side of the glove.

FIG. 8 is a side view of glove 100 with pinky sheath 120 in the foreground and thumb sheath 122 in the background. Back portion 144 is visible in this side view. In some examples, wrist strap 146 is connected to glove 100 along the opening. Wrist strap 146 may be adjustable via a number of mechanisms including hook-and-loop connectors, snaps, and buttons.

Figure 9:
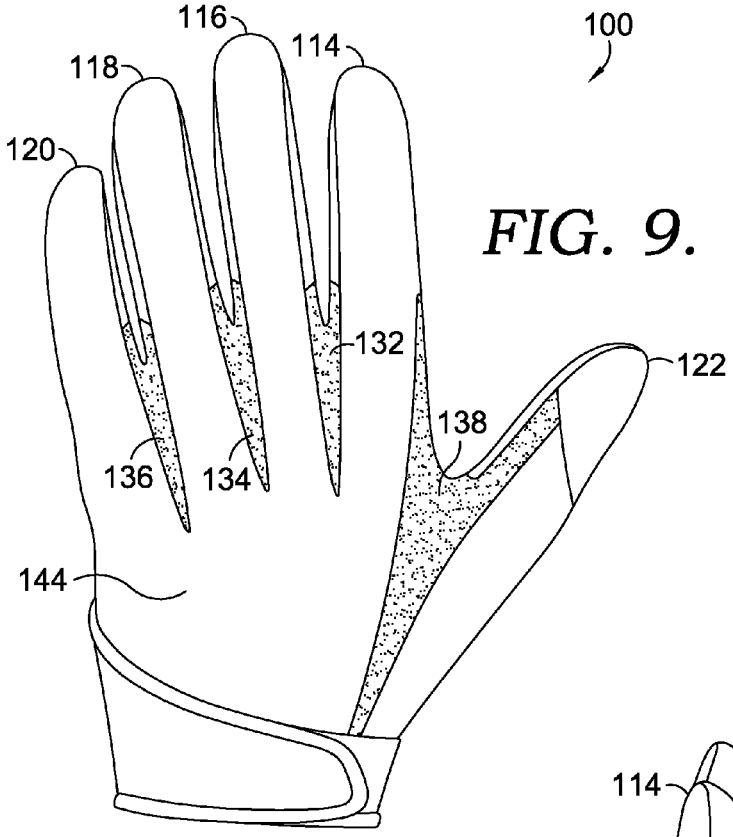
FIG. 9 is a perspective view of a durable athletic glove with enhanced range of motion showing the back of the glove while the glove is in a neutral position.

FIG. 9 is a perspective view of the back of glove 100. Thumb gusset 138 is shown as having a "Y" shape from this view. Other geometries are possible, including a shape similar to that illustrated in FIG. 2 for the portion of thumb gusset 138 on the palm side of glove 100. Strain-relieving gussets 132, 134, and 136 are shown as continuing from the palm-side portion of the glove, between adjacent finger sheaths, and extending down away from finger sheaths 114, 116, 118, and 120. Gussets 132, 134, and 136 may extend between approximately 10 and 80 millimeters beyond the end of finger sheaths 114, 116, 118, and 120. In one particular example, the extension distance is approximately 45 millimeters. In some examples, gussets 132, 134, and 136 do not extend substantially down back portion 144 but end at approximately the same area as the attachment points of finger sheaths 114, 116, 118, and 120.

Figure 10:
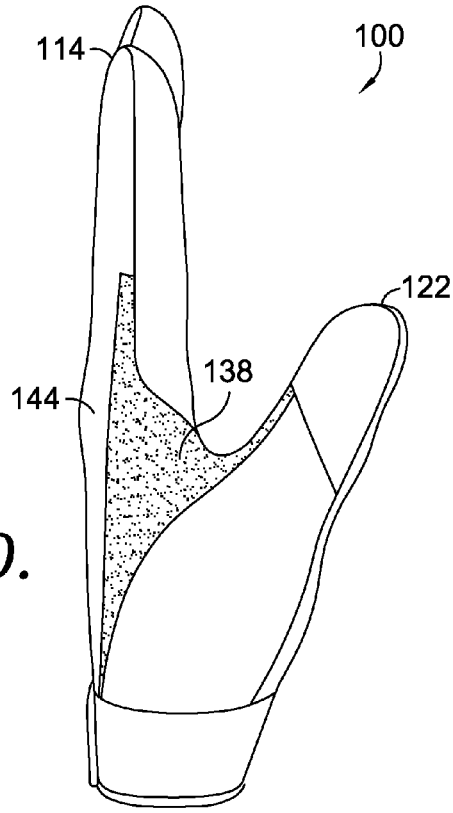
FIG. 10 is a perspective view of a durable athletic glove with enhanced range of motion showing the thumb side of the glove.

FIG. 10 illustrates glove 100 from a side perspective with thumb sheath 122 in the foreground. Although the glove of FIGS. 2-9 is a left-hand glove, right-hand gloves are also contemplated. In addition to being used in sports such as football, glove 100 of FIGS. 2-10 may be used in other cases where maximum hand extension is desired, for instance when worn underneath a fielder's glove in baseball or softball.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. An athletic glove capable of receiving a human hand, the athletic glove comprising:

a back portion;

a palm-side portion having four finger portions, a thumb portion, and a central palm portion, the palm-side portion connected to the back portion to form four finger sheaths, a thumb sheath, and an opening capable of receiving a human hand, the opening located opposite the four finger sheaths and corresponding approximately to the wrist of a user when the glove is worn by the user with fingers of the user extending within the four finger sheaths and the thumb of the user extending within the thumb sheath;

three rounded strain-relieving cutouts, the location of each cutout corresponding to one of the areas on the palm of the user's hand between the distal ends of adjacent finger metacarpals, each cutout forming part of a substantially circular outline when the glove is worn by the user with the user's hand in a neutral position;

for each rounded strain-relieving cutout, a strain-relieving finger gusset connecting the cutout to the corresponding two adjacent finger sheaths; and a thumb gusset connecting the thumb portion to the central palm portion, the thumb gusset extending from the back portion, between the thumb sheath and index finger sheath, and to the palm-side portion.

2. The athletic glove of claim 1, wherein the three strain-relieving gussets are made of a stretchable material.

3. The athletic glove of claim 1, wherein the diameter of the substantially circular outline is between approximately four and twelve millimeters.

4. The athletic glove of claim 1, wherein the thumb gusset is made of a stretchable material.

5. The athletic glove of claim 1, wherein the thumb gusset extends substantially to both the opening adjacent to the back portion and to the opening adjacent to the central palm portion.

6. The athletic glove of claim 1, wherein each strainrelieving finger gusset extends from the corresponding cutout, between the two adjacent finger sheaths, and partially down the back portion toward the opening.

7. The athletic glove of claim 6, wherein each strainrelieving finger gusset extends down the back portion approximately 10 to 80 millimeters from the corresponding pair of adjacent finger sheaths.

8. A football glove capable of receiving a human hand, the glove comprising:

a back portion;

a palm-side portion having four finger portions, a thumb portion, and a central palm portion, the palm-side portion connected to the back portion to form four finger sheaths, a thumb sheath, and an opening capable of receiving a human hand, the opening located opposite the four finger sheaths and corresponding approximately to the wrist of a user when the glove is worn by the user with fingers of the user extending within the four finger sheaths and the thumb of the user extending within the thumb sheath;

three rounded strain-relieving cutouts, the location of each cutout corresponding to one of the areas on the palm of the user's hand between the distal ends of adjacent finger metacarpals, each cutout forming part of a substantially circular outline when the glove is worn by the user with the user's hand in a neutral position;

for each rounded strain-relieving cutout, a strain-relieving finger gusset connecting the cutout to the corresponding two adjacent finger sheaths, each strain-relieving finger gusset extending from the cutout, between the two adjacent finger sheaths, and down the back portion approximately 10 to 80 millimeters from the two adjacent finger sheaths; and a thumb gusset connecting the thumb portion to the central palm portion, the thumb gusset extending substantially from the opening adjacent to the back portion, between the thumb sheath and index finger sheath, and to the opening adjacent to the central palm portion.

9. The athletic glove of claim 8, wherein the diameter of the substantially circular outline is between approximately four and twelve millimeters.

* * * * *